US007775827B2

(12) United States Patent
Huang et al.

(10) Patent No.: US 7,775,827 B2
(45) Date of Patent: Aug. 17, 2010

(54) FLEXIBLE PRINTED CIRCUIT BOARD CONNECTOR

(75) Inventors: Sheng-Yuan Huang, Tu-Cheng (TW); Yung-Chi Peng, Tu-Cheng (TW); Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/292,775

(22) Filed: Nov. 26, 2008

(65) Prior Publication Data

US 2010/0130034 A1 May 27, 2010

(51) Int. Cl.
*H01R 12/24* (2006.01)

(52) U.S. Cl. ..... 439/495

(58) Field of Classification Search ..... 439/495, 439/331, 67

See application file for complete search history.

(56) References Cited

U.S. PATENT DOCUMENTS 4,844,690 A * 7/1989 DeLaurier et al. ..... 415/148

7,118,419 B1 * 10/2006 Lee ..... 439/630

* cited by examiner

*Primary Examiner*—Phuong K Dinh
(74) *Attorney, Agent, or Firm*—Cheng-Ju Chiang

(57) ABSTRACT

A flexible printed circuit board connector adapted for receiving a flexible printed circuit board has an insulating housing including two blocking walls, each defines a lateral side having a buckling cavity at a front thereof and a first and second locating cavities at a rear thereof. The buckling cavity includes a first buckling cavity and a second buckling cavity extending frontward from the first buckling cavity. The second locating cavity is located in front of and spaced from the first locating cavity. A cover defines two lateral plates respectively secured to the lateral sides, each has a locating portion and a buckling portion respectively protruded inwards from an inner side thereof. The locating portion is capable of being pivotally mounted in the first locating cavity, and then the locating portion and the buckling portion can be moved frontward to the second locating cavity and the second buckling cavity, respectively.

9 Claims, 6 Drawing Sheets

FLEXIBLE PRINTED CIRCUIT BOARD CONNECTOR

BACKGROUND OF THE INVENTION

1. Field of the Invention

The present invention relates to a connector, and particularly to a flexible printed circuit board connector.

2. The Related Art

Please refer to FIG. 8 and FIG. 9, which shows a flexible printed circuit board connector 100' in prior art. The flexible printed circuit board connector 100' includes an insulating housing 1', a plurality of terminals 2' received in the insulating housing 1' and a cover 3' rotatably coupled with the insulating housing 1'. The terminals 2' are substantially U-shaped, defining receiving openings 21', and arranged in the insulating housing 1' at intervals. A flexible printed circuit board (not labeled) is inserted in the receiving openings 21', and then the cover 3' is pressed downwardly to engage with the insulating housing 1'. However, during the process of assembly, because the receiving openings 21' of the terminals 2' are disposed between the insulating housing 1' and the cover 3', it is not quite convenient for an operator to insert and position the flexible printed circuit board. Furthermore, the cover 3' mated with the insulating housing 1' can't press the terminals 2' to connect with the flexible printed circuit board steadily.

SUMMARY OF THE INVENTION

Accordingly, an object of the present invention is to provide a flexible printed circuit board connector capable of conveniently inserting and steadily connecting with a flexible printed circuit board. The flexible printed circuit board connector has an insulating housing including two blocking walls disposed at two opposite sides thereof. Each of the blocking walls defines a lateral side having a buckling cavity at a front end thereof and a first and second locating cavities at a rear end thereof. The buckling cavity includes a first buckling cavity extending upwards and downwards, and a second buckling cavity extending frontward from a bottom side of the first buckling cavity. The second locating cavity is located in front of and spaced from the first locating cavity. A plurality of terminals is received in the insulating housing. A cover for holding the flexible printed circuit board defines two lateral plates secured to the lateral sides of the blocking walls. Each of the lateral plates has a locating portion and a buckling portion respectively protruded inwards from a rear and a front of an inner side thereof. The locating portion is capable of being pivotally mounted in the first locating cavity for allowing the buckling portion to be rotated to the bottom of the first buckling cavity and then the locating portion and the buckling portion to be respectively moved frontward to the second locating cavity and the second buckling cavity by a frontward push force.

As described above, the cover is rotatably engaged with the insulating housing after the locating portion pivotally mounted in the first locating cavity. The flexible printed circuit board is held by the cover, which is more convenient to insert and position the flexible printed circuit board. When cover is pressed downwardly and moved frontward, the buckling portion is received in the second buckling cavity so that the cover is secured to the insulating housing firmly, which makes the flexible printed circuit board be pressed downwardly to electrically connect with the terminal steadily.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
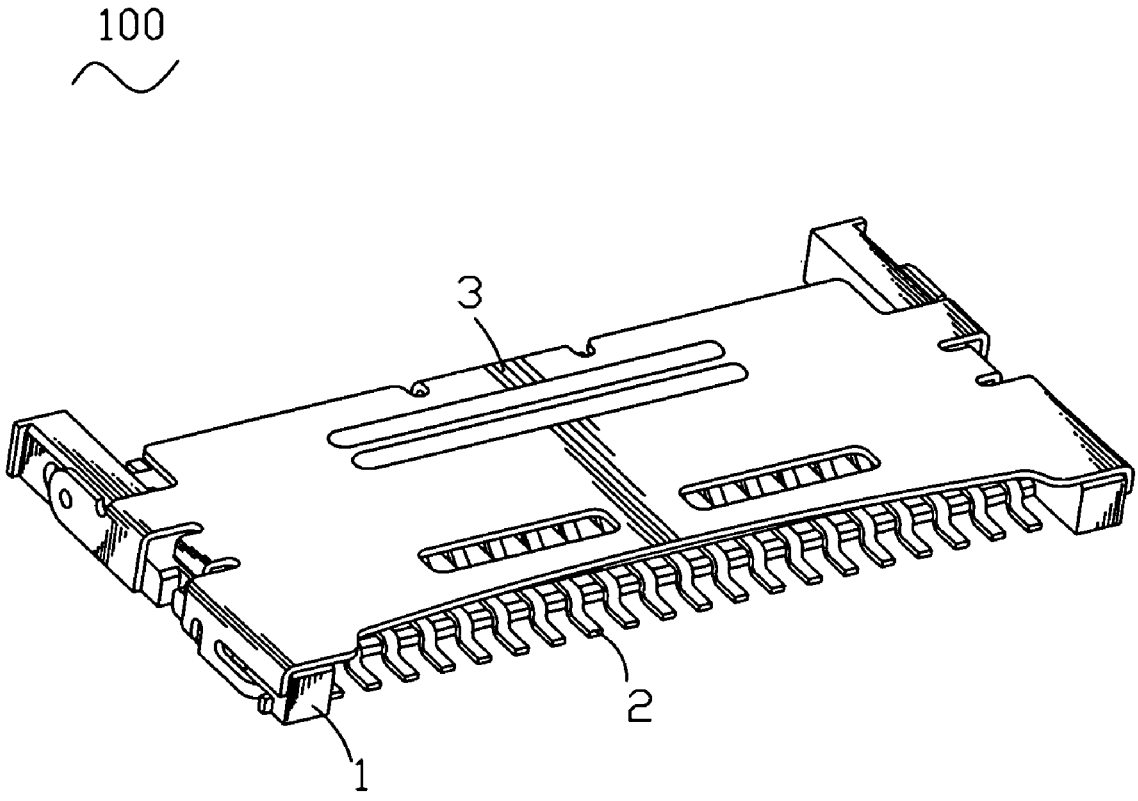
FIG. 1 is an assembled, perspective view of a flexible printed circuit board connector according to an embodiment of the present invention.
Figure 2:
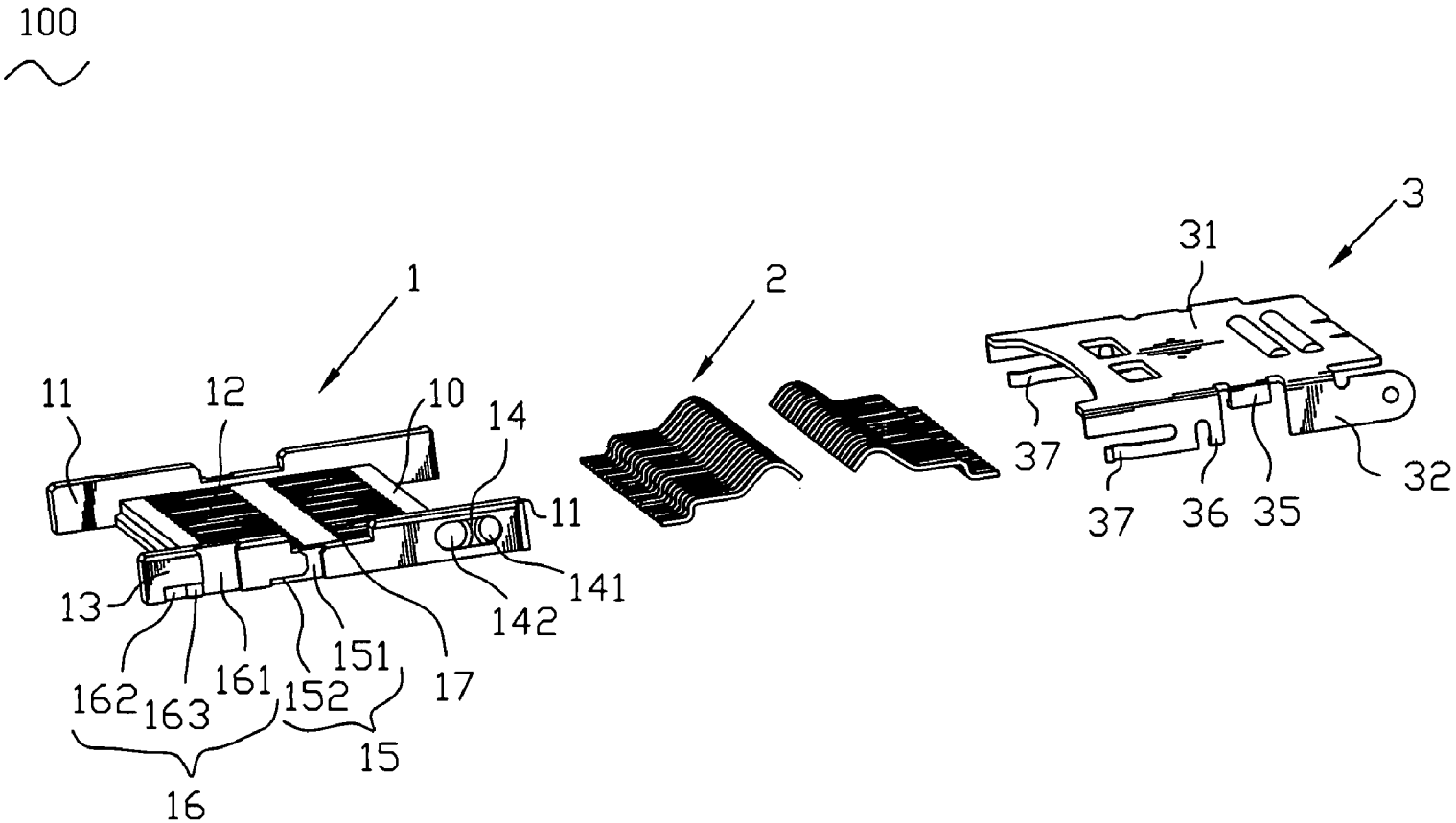
FIG. 2 is an exploded, perspective view of the flexible printed circuit board connector shown in FIG. 1.

With reference to FIG. 1 and FIG. 2, an embodiment of a flexible printed circuit board connector 100 according to the present invention is shown. The flexible printed circuit board connector 100 includes an insulating housing 1, a plurality of terminals 2 received in the insulating housing 1 and a cover 3 mated with the insulating housing 1.

The insulating housing 1 includes a basic plate 10 and two blocking walls 11 disposed at two opposite sides of the basic plate 10. The basic plate 10 is a rectangular shape and has a plurality of terminal recesses 12. The terminal recesses 12 extend parallel to the blocking wall 11 and are arranged at intervals to form two rows. The blocking wall 11 is a substantially elongated-board shape and defines a lateral side 13 opposite to the basic plate 10. The lateral side 13 defines a front end and a rear end. The front end has a buckling cavity 16. The buckling cavity 16 includes a first buckling cavity 161 and a second buckling cavity 162 extending frontward from a bottom side of the first buckling cavity 161. The first buckling cavity 161 extends upwards and downwardly to pass through the whole lateral side 13. A bottom of the second buckling cavity 162 protrudes outwards to form a protrusion 163 adjacent to the first buckling cavity 161. The rear end of the lateral side 13 is recessed inwards to form a limiting cavity 14. The limiting cavity 14 is an elliptic shape and has a first locating cavity 141 and a second locating cavity 142, both concaved from a bottom thereof to show a circular shape and an elliptic shape, respectively. The second locating cavity 142 is located in front of and spaced from the first locating cavity 141. The lateral side 13 further has a fixing cavity 15 located between the limiting cavity 14 and the buckling cavity 16, and a receiving cavity 17 adjacent to the fixing cavity 15. The fixing cavity 15 includes a first fixing cavity 151 extending upwards and downwards and a second fixing cavity 152 extending frontward from a bottom side of the first fixing cavity 151. The receiving cavity 17 is formed at a top of the blocking wall 11 and communicates with the first fixing cavity 151, a bottom surface of which is substantially flush with a top surface of the basic plate 10.

Figure 3:
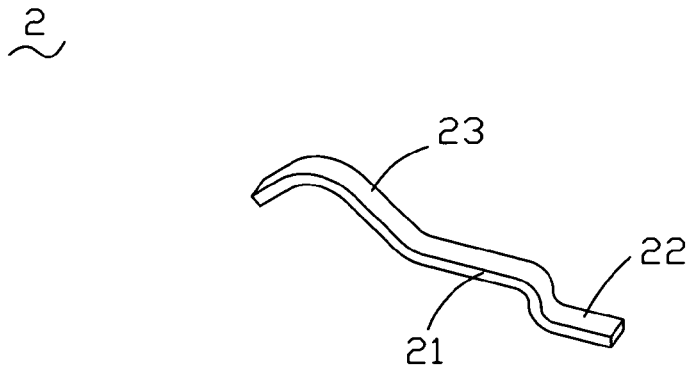
FIG. 3 is a perspective view of a terminal of the flexible printed circuit board connector shown in FIG. 2.

Please refer to FIG. 2 and FIG. 3, the terminal 2 includes a fixing portion 21, a soldering portion 22 and a contacting portion 23. The fixing portion 21 is a flat-board shape. One end of the fixing portion 21 is extended downwardly and curved opposite to the fixing portion 21 to form the soldering portion 22 for being soldered on a printed circuit board (PCB). The other end of the fixing portion 21 extends obliquely and upwards to form a contacting portion 23 of arc shape for electrically connecting with a flexible printed circuit board (not shown).

Figure 4:
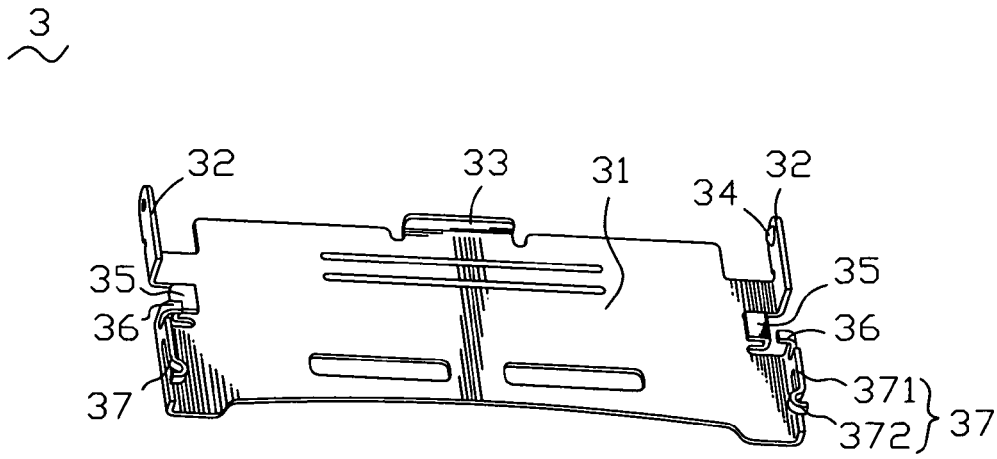
FIG. 4 is a perspective view of a cover of the flexible printed circuit board connector shown in FIG. 2 seen from a bottom view.

Please refer to FIG. 2 and FIG. 4, the cover 3 includes a covering plate 31 and two lateral plates 32 extending downwardly from two opposite sides of the covering plate 31. The covering plate 31 is substantially rectangular. A rear end of the covering plate 31 has a portion bending downwards to form a positioning tab 33 for restraining the flexible printed circuit board. The lateral plate 32 has a locating portion 34, a restraining portion 35, a stopping portion 36 and a buckling element 37. The locating portion 34 corresponding to the limiting cavity 14 is extended inwards from an inner surface of the lateral plate 32 to show a convex shape. In this embodiment, the locating portion 34 may be manufactured by punching the lateral plate 32. The restraining portion 35 received in the receiving cavity 17 may be punched and curved inwards to overlap the covering plate 31 for holding the flexible printed circuit board. The stopping portion 36 spaced away from the restraining portion 35 is bent inwards from a portion of a bottom of the lateral plate 32 and accommodated in the second fixing cavity 152. The buckling element 37 corresponding to the buckling cavity 16 includes a connecting portion 371 and a buckling portion 372. The connecting portion 371 may be punched to extend parallel to the lateral plate 32 and is spaced away from the lateral plate 32 and the stopping portion 36. A distal end of the connecting portion 371 is bent inwards to form the buckling portion 372. The buckling portion 372 received in the second buckling cavity 162 is an arc shape for being against the protrusion 163 for preventing the cover 3 with respect to the insulating housing 1 from moving rearwards.

Figure 5:
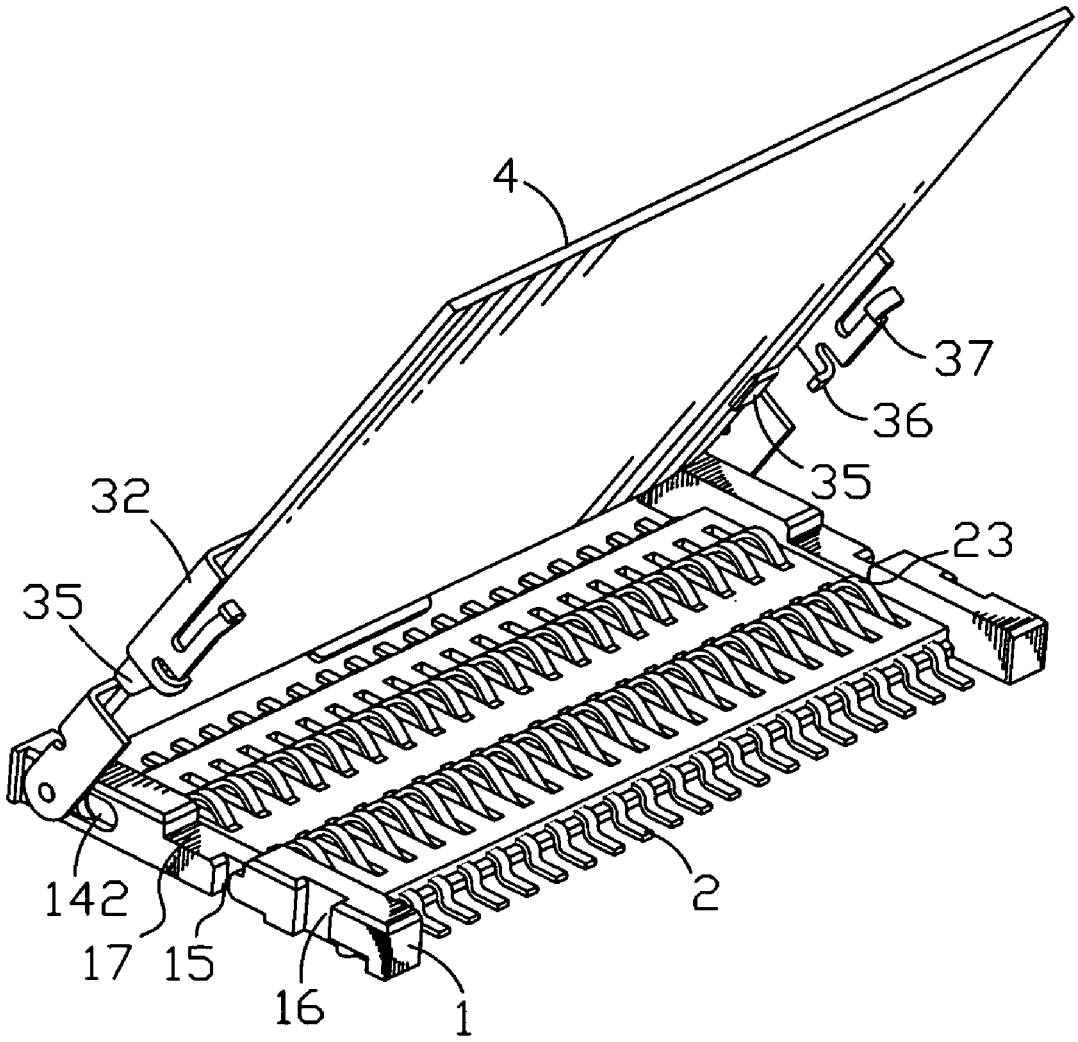
FIG. 5 is an assembled view of the flexible printed circuit board connector shown in FIG. 2, wherein a flexible printed circuit board is inserted into the cover which is lifted.
Figure 6:
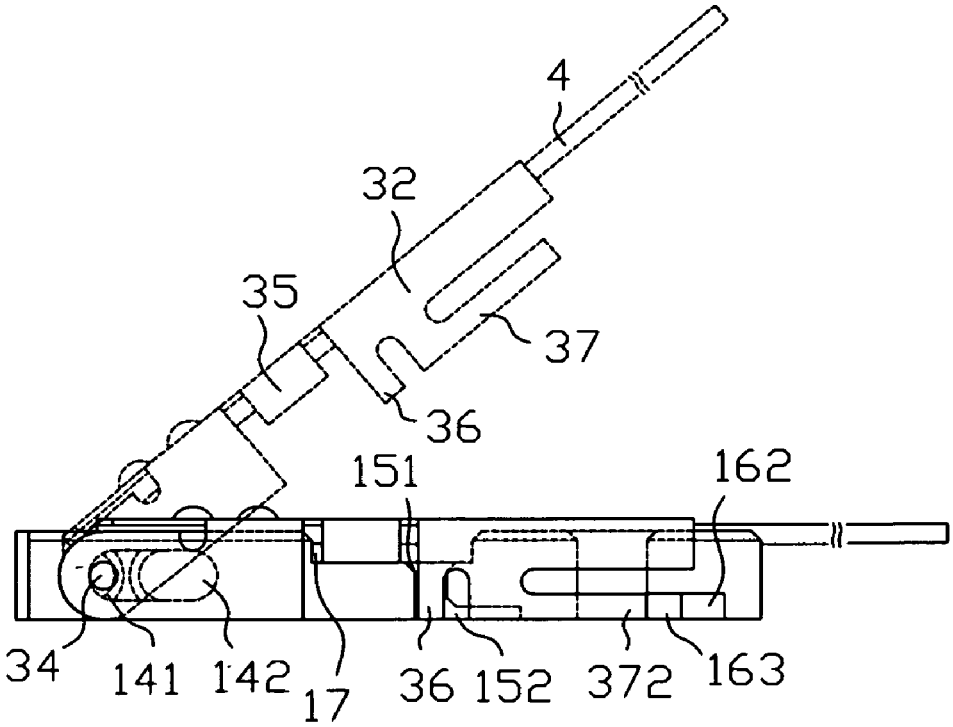
FIG. 6 is a schematic view illustrating a process of the cover being closed to an insulating housing of the flexible printed circuit board connector shown in FIG. 5.
Figure 7:
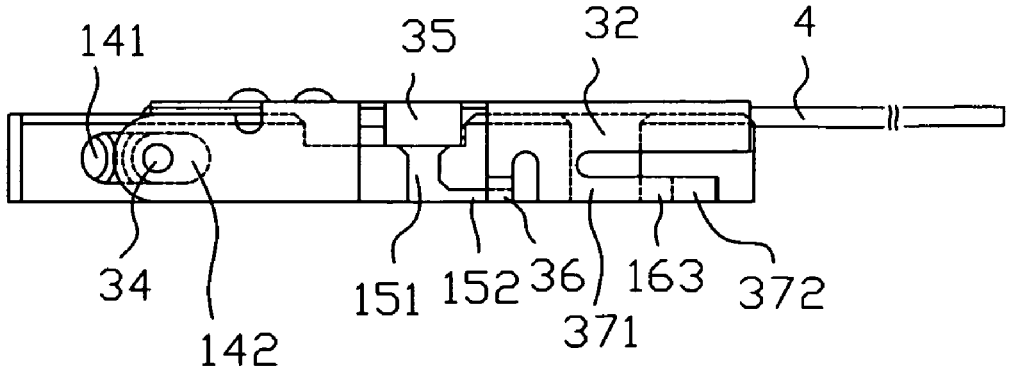
FIG. 7 is a schematic view illustrating a state of the cover shown in FIG. 6 moved to be engaged with the insulating housing.
Figure 8:
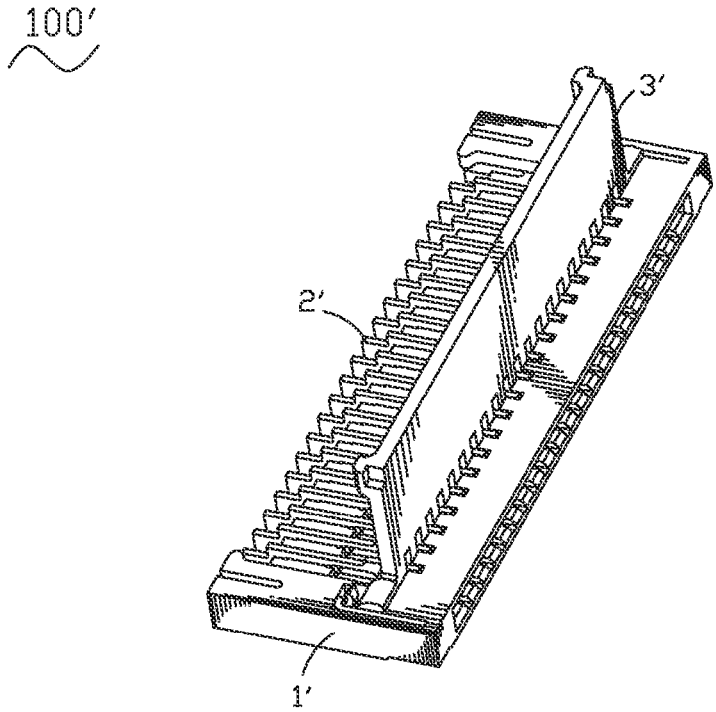
FIG. 8 (Prior Art)
FIG. 8 is an assembled, perspective view of a flexible printed circuit board connector in prior art.
Figure 9:
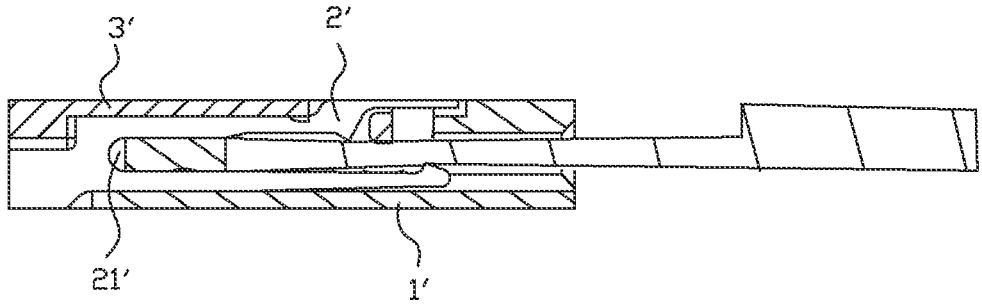
FIG. 9 (Prior Art)
FIG. 9 is a cross-sectional view of the flexible printed circuit board connector shown in FIG. 8, wherein a flexible printed circuit board is inserted therein.

Referring to FIGS. 5-7, in assembly, the fixing portion 21 is received in the terminal recess 12, the soldering portion 22 exceeds the basic plate 10 for being soldered on the PCB, and the contacting portion 23 is disposed over the basic plate 10 for contacting with a flexible printed circuit board 4. The locating portions 34 of the cover 3, firstly, are pivotally engaged with the corresponding first locating cavities 141. At this time, the cover 3 can be rotated with respect to the insulating housing 10. The flexible printed circuit board 4 is inserted along the covering plate 31 and is restrained by the positioning tab 33 and restraining portions 35. Press the cover 3 downwardly so that the restraining portions 35 are placed into the corresponding receiving cavities 17, the stopping portion 36 slides into a bottom of the first fixing cavity 151, and the buckling portion 372 slides into a bottom of the first buckling cavity 161. Then the cover 3 is pushed frontward by a frontward push force until the buckling portion 372 is slid across the protrusion 163 to be accommodated in the second buckling cavity 162 for restraining the cover 3 from moving rearwards. The locating portion 34 is received in the second locating cavity 142, and the stopping portion 36 is placed in the second fixing cavity 152 for preventing the cover 3 from moving upwards. Thus the flexible printed circuit board connector 100 is assembled completely. When requiring opening the flexible printed circuit board connector 100, the cover 3 can be pushed rearwards and then lifted.

As described above, the cover 3 is rotatably engaged with the insulating housing 1 after the locating portions 34 pivotally mounted in the first locating cavities 141. The flexible printed circuit board 4 is held by the positioning tab 33 and the restraining portions 35, which is more convenient to insert and position the flexible printed circuit board 4. When the cover 3 is pressed downwardly and moved frontward, the stopping portion 36 and the buckling portion 372 are respectively received in the second fixing cavity 152 and the second buckling cavity 162, which makes the cover 3 be secured to the insulating housing 1 firmly. Thus the flexible printed circuit board 4 is pressed downwardly to electrically connect with the terminal 2 steadily.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A flexible printed circuit board connector adapted for receiving a flexible printed circuit board, comprising:

an insulating housing including two blocking walls disposed at two opposite sides thereof, each of the blocking walls defining a lateral side, the lateral side having a buckling cavity at a front end thereof and a first and second locating cavities at a rear end thereof, the buckling cavity including a first buckling cavity extending upwards and downwards, and a second buckling cavity extending frontward from a bottom side of the first buckling cavity, the second locating cavity located in front of and spaced from the first locating cavity;

a plurality of terminals received in the insulating housing; and a cover for holding the flexible printed circuit board, the cover defining two lateral plates secured to the lateral sides of the blocking walls, each of the lateral plates having a locating portion and a buckling portion respectively protruded inward from a rear and a front of an inner side thereof, the locating portion capable of being pivotally mounted in the first locating cavity for allowing the buckling portion to be rotated to the bottom of the first buckling cavity, and then the locating portion and the buckling portion to be respectively moved frontward to the second locating cavity and the second buckling cavity by a frontward push force;

wherein each of the lateral plates of the cover has a buckling element, the buckling element includes a connecting portion extending frontward and rearwards and spaced away from the lateral plate, and the buckling portion curved inwards from a distal end of the connecting portion to show an arc shape.

2. The flexible printed circuit board connector as claimed in claim 1, wherein the rear end of the lateral side defines a limiting cavity of substantially elliptic shape, the first locating cavity and the second locating cavity are concaved from a bottom of the limiting cavity to show a round shape and an elliptic shape, respectively.

3. The flexible printed circuit board connector as claimed in claim 1, wherein the second buckling cavity protrudes outwards to form a protrusion adjacent to the first buckling cavity to block the buckling portion for preventing the cover from moving rearwards.

4. The flexible printed circuit board connector as claimed in claim 1, wherein the insulating housing has a receiving cavity, which is formed at a top of the blocking wall, the lateral plate has a restraining portion, which is perpendicularly bent inwards from a portion of a bottom thereof, and received in the receiving cavity for holding the flexible printed circuit board.

5. The flexible printed circuit board connector as claimed in claim 1, wherein the cover includes a covering plate and the two lateral plates extending downwardly from two opposite sides of the covering plate, a rear end of the covering plate has a portion bent downwardly to form a positioning tab for restraining the flexible printed circuit board.

6. A flexible printed circuit board connector adapted for receiving a flexible printed circuit board, comprising:

an insulating housing including two blocking walls disposed at two opposite sides thereof, each of the blocking walls defining a lateral side, the lateral side having a buckling cavity at a front end thereof and a first and second locating cavities at a rear end thereof, the buckling cavity including a first buckling cavity extending upwards and downwards, and a second buckling cavity extending frontward from a bottom side of the first buckling cavity, the second locating cavity located in front of and spaced from the first locating cavity;

a plurality of terminals received in the insulating housing; and a cover for holding the flexible printed circuit board, the cover defining two lateral plates secured to the lateral sides of the blocking walls, each of the lateral plates having a locating portion and a buckling portion respectively protruded inward from a rear and a front of an inner side thereof, the locating portion capable of being pivotally mounted in the first locating cavity for allowing the buckling portion to be rotated to the bottom of the first buckling cavity, and then the locating portion and the buckling portion to be respectively moved frontward to the second locating cavity and the second buckling cavity by a frontward push force;

wherein the second buckling cavity protrudes outwards to form a protrusion adjacent to the first buckling cavity to block the buckling portion for preventing the cover from moving rearwards.

7. The flexible printed circuit board connector as claimed in claim 6, wherein the rear end of the lateral side defines a limiting cavity of substantially elliptic shape, the first locating cavity and the second locating cavity are concaved from a bottom of the limiting cavity to show a round shape and an elliptic shape, respectively.

8. The flexible printed circuit board connector as claimed in claim 6, wherein the insulating housing has a receiving cavity, which is formed at a top of the blocking wall, the lateral plate has a restraining portion, which is perpendicularly bent inwards from a portion of a bottom thereof, and received in the receiving cavity for holding the flexible printed circuit board.

9. The flexible printed circuit board connector as claimed in claim 6, wherein the cover includes a covering plate and the two lateral plates extending downwardly from two opposite sides of the covering plate, a rear end of the covering plate has a portion bent downwardly to form a positioning tab for restraining the flexible printed circuit board.

* * * * *